US006942004B2

(12) United States Patent
Whittemore

(10) Patent No.: US 6,942,004 B2
(45) **Date of Patent: *Sep. 13, 2005**

(54) PARTITION MOUNT

(75) Inventor: Jeffrey P. Whittemore, Arlington, MA (US)

(73) Assignee: Zipwall, LLC, Arlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/301,233

(22) Filed: Nov. 21, 2002

(65) Prior Publication Data

US 2003/0070773 A1 Apr. 17, 2003

Related U.S. Application Data

(63) Continuation of application No. 09/884,337, filed on Jun. 19, 2001, now Pat. No. 6,508,295, which is a continuation of application No. 09/613,645, filed on Jul. 11, 2000, now Pat. No. 6,321,823, which is a continuation of application No. 09/302,122, filed on Apr. 29, 1999, now Pat. No. 6,209,615, which is a continuation of application No. 08/740,372, filed on Oct. 29, 1996, now Pat. No. 5,924,629.

(51) Int. Cl.[7] ..... A47H 13/00

(52) U.S. Cl. ..... 160/368.1; 160/351; 160/402; 248/200.1; 24/113 MP

(58) Field of Search ..... 160/368.1, 350, 160/351, 379, 330, 380, 399, 402; 248/200.1; 403/326, 329; 24/92, 113 MP, 113 R, 114

(56) References Cited

U.S. PATENT DOCUMENTS

| | | | | |
|---|---|---|---|---|
| ,827,000 A | | 7/1906 | Dinsmore | |
| 1,766,324 A | | 6/1930 | Berner | |
| 2,219,169 A | | 10/1940 | Alter | 248/1 |
| 2,232,194 A | | 2/1941 | Zogby | 156/33 |
| 2,474,158 A | | 6/1949 | Neely | 155/180 |
| 2,816,769 A | | 12/1957 | Noble | 279/83 |
| 2,903,227 A | | 9/1959 | de Kalb Key | 248/356 |
| 2,942,829 A | * | 6/1960 | Stiffel | 160/368.1 X |
| 3,072,784 A | | 1/1963 | Mann | 240/81 |
| 3,090,826 A | | 5/1963 | Cochran | 174/158 |
| 3,118,363 A | | 1/1964 | Burgess, Jr. | |
| 3,247,558 A | | 4/1966 | Kaufman | 24/81 |
| 3,322,381 A | | 5/1967 | Bubb | 248/121 |
| 3,327,310 A | | 6/1967 | Bethune et al. | 343/702 |

(Continued)

FOREIGN PATENT DOCUMENTS

| | | | | |
|---|---|---|---|---|
| DE | 3918516 | | 6/1989 | E04G/25/04 |
| DE | 04420849 A | * | 6/1994 | 160/368.1 X |
| DE | 29605222 | | 7/1996 | E04G/25/08 |
| FR | 2411282 | | 6/1979 | E04B/2/74 |
| GB | 1042086 | | 9/1966 | |
| GB | 2156894 | * | 10/1985 | 160/368.1 X |
| WO | WO 86/03538 | | 6/1986 | E04G/1/26 |
| WO | WO91/09556 | | 7/1991 | A47G/5/00 |
| WO | WO 91/09556 | * | 7/1991 | 160/168.1 X |

*Primary Examiner*—Bruce A. Lev
(74) *Attorney, Agent, or Firm*—Mills & Onello LLP

(57) ABSTRACT

In a spring-loaded curtain mount, the mount includes a pole interface at a proximal end, a compressive mechanism, and a head at a distal end. The pole interface is adapted to receive the end of a standard length adjustable pole or a painter's pole. The compression mechanism is disposed between the proximal end of the mount and the head. The mount includes a coupling device adapted to receive a portion of a curtain. During installation, the curtain mount is coupled to the end of an extension pole and the length of the pole is adjusted such that the combined length of the pole and mount is slightly longer than the distance between the floor and ceiling. At ground level, a portion of the curtain is attached to the head of the curtain mount. The curtain and mount are raised to the ceiling and the mount and pole are compressed between the floor and the ceiling. This compressive force operates to urge the head toward the ceiling, securing the mount in place.

61 Claims, 12 Drawing Sheets

U.S. PATENT DOCUMENTS 3,333,808 A 8/1967 Du Boff ..... 248/354
3,350,120 A 10/1967 Hinrichs ..... 287/58
3,529,860 A 9/1970 Jelley ..... 287/189.36
3,592,434 A 7/1971 Murray ..... 248/480
3,604,397 A * 9/1971 Salerno ..... 119/29
3,608,991 A * 9/1971 Wade ..... 312/345
3,713,643 A * 1/1973 Gerstenberger ..... 270/61 R
3,767,253 A 10/1973 Kluetsch ..... 296/24 R
3,792,510 A 2/1974 Evett ..... 24/243
3,822,850 A 7/1974 Elias ..... 248/354 S
3,858,988 A 1/1975 Cohen
3,861,663 A * 1/1975 Strickland ..... 269/26
3,952,877 A 4/1976 Kindl ..... 211/105.5
3,956,784 A * 5/1976 Vargas ..... 5/362
3,972,272 A 8/1976 Bagby ..... 98/50
3,994,463 A 11/1976 Baker
4,078,756 A 3/1978 Cross ..... 248/226.4
4,087,006 A 5/1978 Schill ..... 211/86
4,111,217 A * 9/1978 Victor ..... 135/15
4,127,911 A 12/1978 Cupp et al.
4,139,101 A * 2/1979 Towfigh ..... 211/86
4,277,863 A 7/1981 Faneuf ..... 24/3
4,379,654 A 4/1983 Rovelli ..... 405/53
4,396,325 A 8/1983 Joice-Cavanagh ..... 410/129
4,488,651 A 12/1984 Bishop ..... 211/105.6
4,502,256 A 3/1985 Hahn ..... 52/63
4,536,924 A 8/1985 Willoughby ..... 24/487
4,576,354 A * 3/1986 Blessing, Sr. ..... 248/354.5
4,592,797 A * 6/1986 Carlson ..... 156/574
4,645,473 A 2/1987 Mochizuki ..... 464/79
4,662,034 A 5/1987 Cunningham ..... 24/90
4,708,189 A 11/1987 Ward ..... 160/351
4,715,089 A 12/1987 Schema ..... 16/115
4,717,107 A * 1/1988 Servadio ..... 248/353
4,770,086 A * 9/1988 Gabster ..... 98/50
4,794,974 A * 1/1989 Melino ..... 160/330
4,824,302 A 4/1989 Schultheis et al. ..... 410/151
4,852,844 A * 8/1989 Villaveces ..... 248/314
4,874,028 A 10/1989 Lynch et al. ..... 160/332
4,885,876 A 12/1989 Henke ..... 51/393
4,907,835 A 3/1990 Salters ..... 296/1.1
4,912,814 A * 4/1990 McKenzie ..... 24/115 H
4,928,916 A 5/1990 Molloy
4,969,241 A 11/1990 Griffin ..... 24/113
5,038,889 A 8/1991 Jankowski ..... 182/129
5,040,915 A * 8/1991 Stuart et al. ..... 403/322
5,056,753 A 10/1991 Lunau et al. ..... 248/542
5,078,348 A * 1/1992 Babitchenko ..... 248/124
5,116,012 A * 5/1992 Offenhauer et al. ..... 248/452
5,129,774 A 7/1992 Balseiro et al. ..... 414/11
5,131,781 A 7/1992 Klein
5,170,974 A 12/1992 Ruggiero ..... 248/251
5,240,058 A * 8/1993 Ward ..... 160/123
5,287,614 A * 2/1994 Ehrlich ..... 29/450
5,299,773 A * 4/1994 Bertrand ..... 248/514
5,301,915 A * 4/1994 Bahniuk et al. ..... 248/452
5,308,280 A 5/1994 Dotson ..... 454/170
5,331,706 A 7/1994 Graham
5,345,989 A 9/1994 Brophy ..... 160/354
5,375,303 A 12/1994 Shenier ..... 24/163
5,379,491 A * 1/1995 Solo ..... 24/3 R
5,384,938 A 1/1995 Frederick ..... 24/306
5,388,283 A 2/1995 Garnett ..... 4/503
5,404,602 A 4/1995 Kondo ..... 5/504.1
5,469,607 A 11/1995 Henningsson et al. ..... 24/716
5,497,537 A * 3/1996 Robinson et al. ..... 24/716
5,524,693 A 6/1996 Hamilton ..... 160/243
5,529,326 A * 6/1996 Hwang ..... 280/220
5,536,229 A 7/1996 Albergo ..... 482/148
5,542,209 A 8/1996 Sheu ..... 47/44
5,555,607 A 9/1996 Parveris ..... 24/129 R
5,558,501 A * 9/1996 Wang et al. ..... 416/244
5,584,456 A 12/1996 Stephens ..... 248/214
5,640,826 A * 6/1997 Hurilla, Jr. ..... 52/749.14
5,645,272 A * 7/1997 Brennan, Sr. ..... 269/68
5,649,780 A 7/1997 Schall ..... 403/109
5,666,702 A 9/1997 Ming-Chieh ..... 24/510
5,673,741 A 10/1997 Cairns ..... 160/330
5,707,032 A 1/1998 Ehrlich ..... 248/205.3
5,715,620 A 2/1998 Walker ..... 40/591
5,722,691 A * 3/1998 Patel ..... 281/42
5,803,653 A 9/1998 Zuffetti ..... 403/363
5,884,424 A 3/1999 Smith ..... 40/610
5,897,085 A 4/1999 Cronin ..... 248/200.1
5,924,469 A 7/1999 Whittemore ..... 160/368.1
5,937,488 A 8/1999 Geiger ..... 24/339
5,940,942 A 8/1999 Fong ..... 24/459
5,941,434 A 8/1999 Green ..... 224/250
5,941,586 A * 8/1999 Fann ..... 294/19.1
5,944,464 A 8/1999 Cole, Jr.
5,979,110 A 11/1999 Tai ..... 47/41.01
6,067,691 A * 5/2000 Feltman ..... 24/295
6,082,945 A 7/2000 Jeffries et al.
6,152,434 A 11/2000 Gluck ..... 269/6
6,164,605 A 12/2000 Drake et al. ..... 248/74.3
6,170,112 B1 1/2001 Mayfield et al.
6,209,615 B1 4/2001 Whittemore ..... 160/368.1
6,378,175 B1 4/2002 Vanderpan ..... 24/336
6,467,741 B1 * 10/2002 Shih ..... 248/200.1
6,474,609 B1 * 11/2002 Pinard ..... 248/303
6,508,295 B2 * 1/2003 Whittemore ..... 160/368.1
6,523,231 B1 2/2003 Lassiter ..... 24/339
2001/0029640 A1 * 10/2001 Cassar ..... 15/144.1
2003/0154588 A1 * 8/2003 Blacket et al. ..... 29/456

* cited by examiner

PARTITION MOUNT

RELATED APPLICATIONS

This application is a continuation of U.S. application Ser. No. 09/884,337, filed Jun. 19, 2001, now U.S. Pat. 6,508,295, which is a continuation of U.S. application Ser. No. 09/613,645, filed Jul. 11, 2000, now U.S. Pat. No. 6,321,823, which is a continuation of U.S. application Ser. No. 09/302,122, filed Apr. 29, 1999, now U.S. Pat. No. 6,209,615, which is a continuation of U.S. application Ser. No. 08/740,372, filed Oct. 29, 1996, now U.S. Pat. No. 5,924,629, the contents of the applications being incorporated herein by reference.

BACKGROUND OF THE INVENTION

Partition systems are often employed to separate portions of a building or room. Partitions serve as a barrier to dust, noise, light, odors, and the like. In construction zones, partitions are useful for protecting a clean area from a work area, for example, protecting an area where furniture and rugs are temporarily stored from an area where wood floors are being refinished.

Workers at construction sites often use rudimentary techniques for installing partitions. Some simply nail, screw, or staple the curtain or partition material to the floor, ceiling, and abutting walls, resulting in damage to their surfaces. Others tape or otherwise adhere a curtain or plastic sheet to the walls and ceilings. The tape usually fails to stick, but if it does stick, as the tape is removed, paint usually pulls off with the tape or adhesive is left behind.

Others employ more clever techniques for constructing partitions. U.S. Pat. No. 4,794,974 discloses a curtain wall having spring-loaded extendable support legs which support header elements aligned along the ceiling. A curtain is mounted to the header elements with fasteners along the length of each header element. This design suffers from several limitations. The support poles, header elements, fasteners, and curtain all comprise dedicated hardware, increasing manufacturing costs. Particularly, the curtain must be designed to accommodate the fasteners. In addition, installation appears to be awkward and time consuming due to the multitude of fasteners and the system appears to be top-heavy during installation.

U.S. Pat. No. 4,708,189 discloses a spring-loaded curtain support having a plurality of support units extending from the floor to the ceiling. Each support unit includes a stackable extension member, a telescoping section, a lower batten, and an upper batten. The lower and upper battens extend along the floor and ceiling respectively and interlock so as to provide a continuous batten along the floor and ceiling. A curtain is designed to loop around the upper batten and accommodate the extension poles. This design again requires dedicated hardware, including a curtain which is designed specifically to accept a particular upper batten size and shape and a particular extension pole. The structure is bulky and appears tedious to install.

U.S. Pat. No. 5,308,280 discloses a coal mine ventilation curtain support. An adjustable extension pole is erected between the floor and ceiling of a mine. A curtain support member compresses between the extension pole resting on the floor, and the ceiling such that the compressive force urges the support member against the ceiling, thereby securing a curtain in place against the ceiling. Although this design accommodates any type of curtain material, it again suffers from the limitation of requiring dedicated hardware as the support member is designed for a particular extension pole. In addition, installation appears challenging in rooms with tall ceilings as the curtain is installed after the mount is raised and installed. Following installation of the support member, an installer must climb up to the ceiling and pull back a leg of the support member, insert a curtain and snap the support member back into the ceiling. In a home construction project, the snapping action may damage the ceiling. In addition, for ceilings higher than the reach of the installer, this design may prove to be challenging to install. This design presents the further unfortunate possibility that the installer could jam his fingers between the support member and ceiling.

SUMMARY OF THE INVENTION

The present invention is directed to a partition mount apparatus and method which overcome the limitations of the prior art. The inventive method and apparatus are applicable to use in construction zones in preventing contaminants such as dust and paint from entering clean areas in a home or office. The invention may also be used as a temporary visual, odor, or sound barrier, depending on the curtain material employed. The present invention offers the advantages of accommodating standard extension poles, for example, painters poles, with standard threads, and is compatible with a variety of commercially-available curtain or drape materials, for example plastic, cloth, or the like. The invention is a "clean" system designed to be installed and removed without damaging or otherwise marking the ceiling, floor or walls in the construction zone. Assembly is easy and fast and can be accomplished by a single individual. In a preferred method for assembling the partition of the present invention, the curtain mounts and curtain are first assembled on the floor and then raised to the ceiling permitting safe installation in rooms with high ceilings, for example cathedral ceilings.

One embodiment of the invention comprises a spring-loaded mount including a hole at a proximal end, a compression mechanism, and a head at a distal end. The hole is adapted to receive the end of a standard length-adjustable pole or painters pole. In a preferred embodiment, the compressive mechanism comprises a spring under compression between an inner wall of the mount and the head. The head is urged toward the ceiling by the compressive mechanism, providing longitudinal rigidity to the installed mount. The head preferably interfaces with the mount at a swivel joint so that the mount can be installed at a range of orientations relative to the ceiling.

The head preferably includes a coupling device, for example, a Velcro™ hook and loop fastener strip, a hook, or a clip, adapted to receive a portion of a curtain. In a first preferred embodiment of the invention, the face of the head includes a sheet of Velcro™ hooks which mates with a sheet of Velcro™ loops attached to the curtain. On the side of the curtain opposite the Velcro™ loops, a high-friction material provides friction between the mount and the ceiling, so that the curtain is less likely to slide relative to the ceiling thereby providing lateral rigidity. In a second preferred embodiment of the invention, a removable clip couples the curtain to the head. The clip is adapted to receive a section of curtain material and snap on or otherwise secure to the head. High friction material attached to the back of the clip provides lateral rigidity as described above.

In alternative embodiments, the curtain mount may be adapted to receive poles without threads, or may include a pin for interfacing with a corresponding hole in a pole. Furthermore, the elements of the curtain mount may be distributed along the pole. The extension poles do not necessarily need to be adjustable in situations where the ceiling size is standard or predetermined.

In the inventive method of the present invention, a spring-loaded curtain mount is coupled to the end of a standard adjustable pole, and the length of the pole is adjusted such that the combined length of the pole and mount is slightly longer than the distance between the floor and ceiling. A portion of the curtain is attached to the curtain mount. The curtain and mount are raised to the ceiling and the mount and pole are compressed between and the floor and ceiling. This compressive force operates to urge the head toward the ceiling. The same compressive force operating through the high friction material on the head or curtain provides lateral rigidity for the system.

The mount is free-standing and therefore does not require additional "destructive" mounting means, for example nailing or taping. Instead, the mount is installed and removed without permanent damage to the ceiling or floor.

By placing several mounts between the ceiling and floor, across a room or portions thereof, the room can be partitioned to protect furniture and the like during construction of other portions of the room. The curtain can also be installed along the ceiling and/or floor for constructing a tunnel or booth. The shape of the partition is variable depending on the respective spatial positions of the mounts.

BRIEF DESCRIPTION OF THE DRAWINGS

The foregoing and other objects, features and advantages of the invention will be apparent from the following more particular description of preferred embodiments and the drawings in which like reference characters refer to the same parts throughout the different views. The drawings are not necessarily to scale, emphasis instead being placed upon illustrating the principals of the invention.

DETAILED DESCRIPTION OF PREFERRED EMBODIMENTS

Figure 1A:
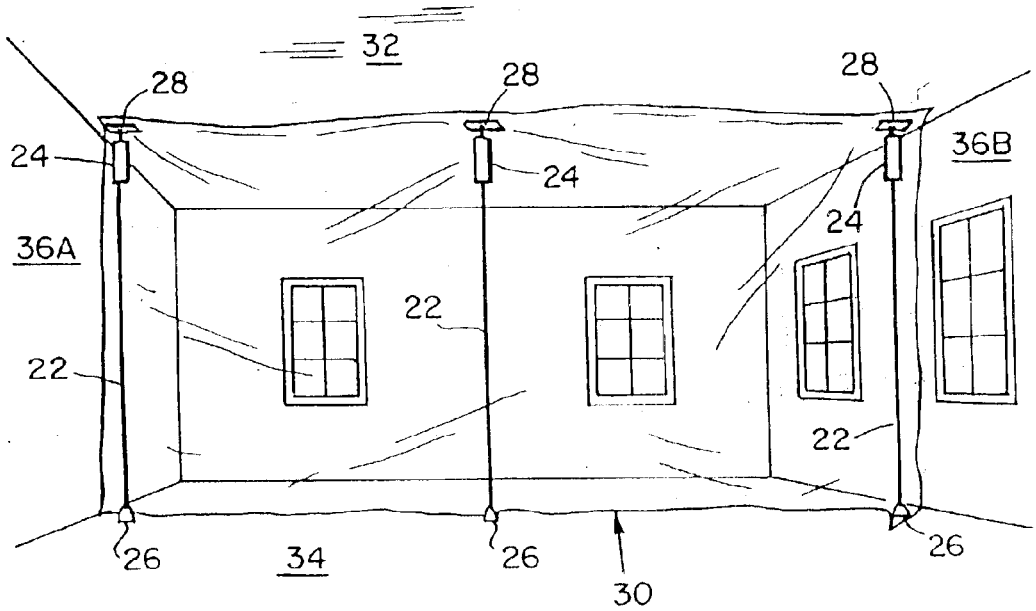
FIGS. 1A, 1B, and 1C illustrate installed partition configurations in accordance with the present invention.

FIG. 1A illustrates an installed partition extending from the floor 34 to the ceiling 32 of a room between opposed walls 36A, 36B. Three curtain mounts 24 in accordance with the present invention are mounted on extension poles 22. A foot 26 at the bottom of each extension pole interfaces with the floor and a head 28 at the top of each curtain mount interfaces with the ceiling 32. The contact or interface points of the foot and head preferably are covered with a soft friction material such as rubber to provide lateral rigidity of the system and to prevent marking of the ceiling and floor.

Each curtain mount includes a compression mechanism, for example a spring, which operates to urge the head 28 against the ceiling 32, thereby securing the curtain 30. The extension poles 22 are preferably adjustable such that before installation of the curtain 30, the pole length in combination with the fully extended curtain mount 24 can be made slightly larger than the distance from the floor 34 to the ceiling 32 at the point at which the curtain mount is to be installed. For example, if the compression range of the spring is 2–3 inches, then the total length of the pole 22 and mount 24 can be made 2–3 inches longer than the floor-to-ceiling 32 height, causing the spring to be compressed when the system is installed. Alternatively, non-adjustable standard poles such as painters poles sized for particular predetermined ceiling heights may be employed.

Figure 1B:
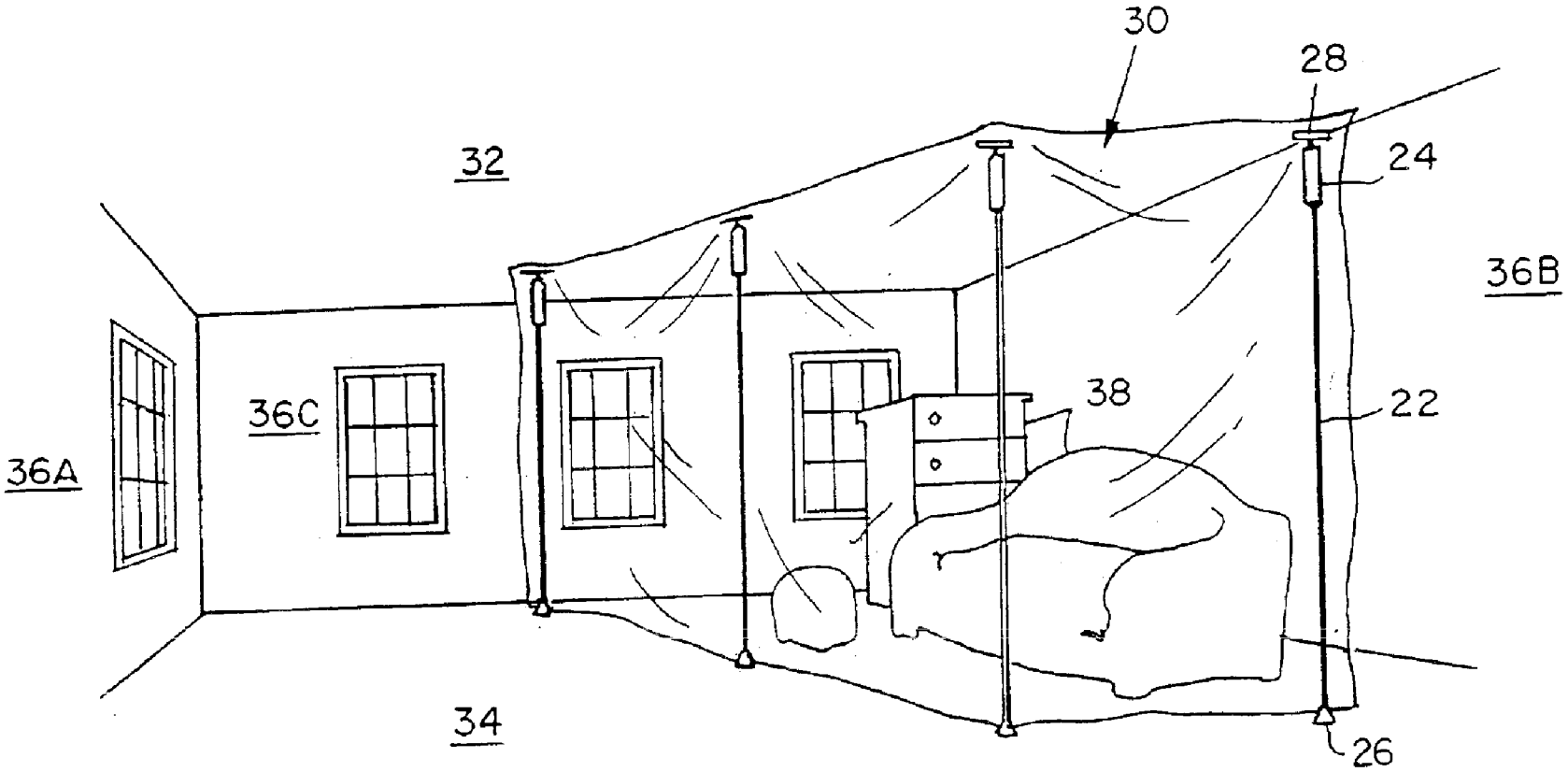

FIG. 1B illustrates the present invention installed to partition a portion of a room extending between adjacent walls 36B,36C. In this illustration, the curtain 30 is installed to protect furniture 38 from dust and debris during painting or other construction in the open portion of the room.

Figure 1C:
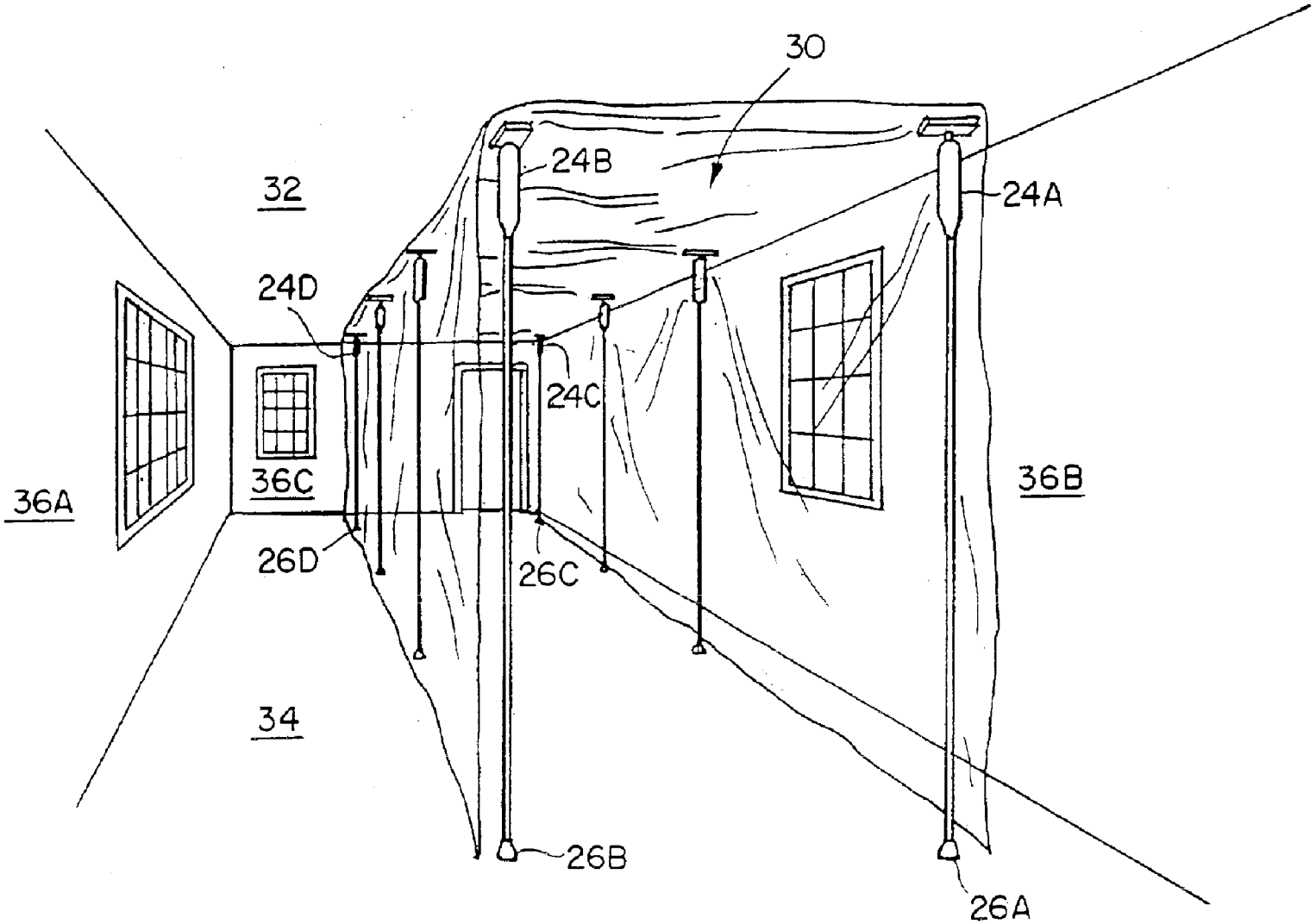

FIG. 1C illustrates the present invention configured as a tunnel or booth. In this installation, the curtain 30 extends along the ceiling 32 between mounts 24A, 24B, 24C, and 24D, protecting the ceiling 32 from activity in the tunnel. The curtain 30 can be tucked under feet 26A–26D to secure the curtain to the floor 34. The curtain 30 may also be installed between the feet 26A–26D on the floor to provide an enclosed tunnel. The sides of the tunnel may be formed by a single continuous curtain 30 or multiple curtains 30, the edges of each held in place and raised by the mounts 24A–24D. This configuration is particularly well suited to serve as an asbestos removal tunnel or paint booth.

Note that for purposes of the present invention, the term "curtain" is defined to include any flexible material suited for partitioning, for example cloth sheets and drapes, or plastic tarps.

Figure 2:
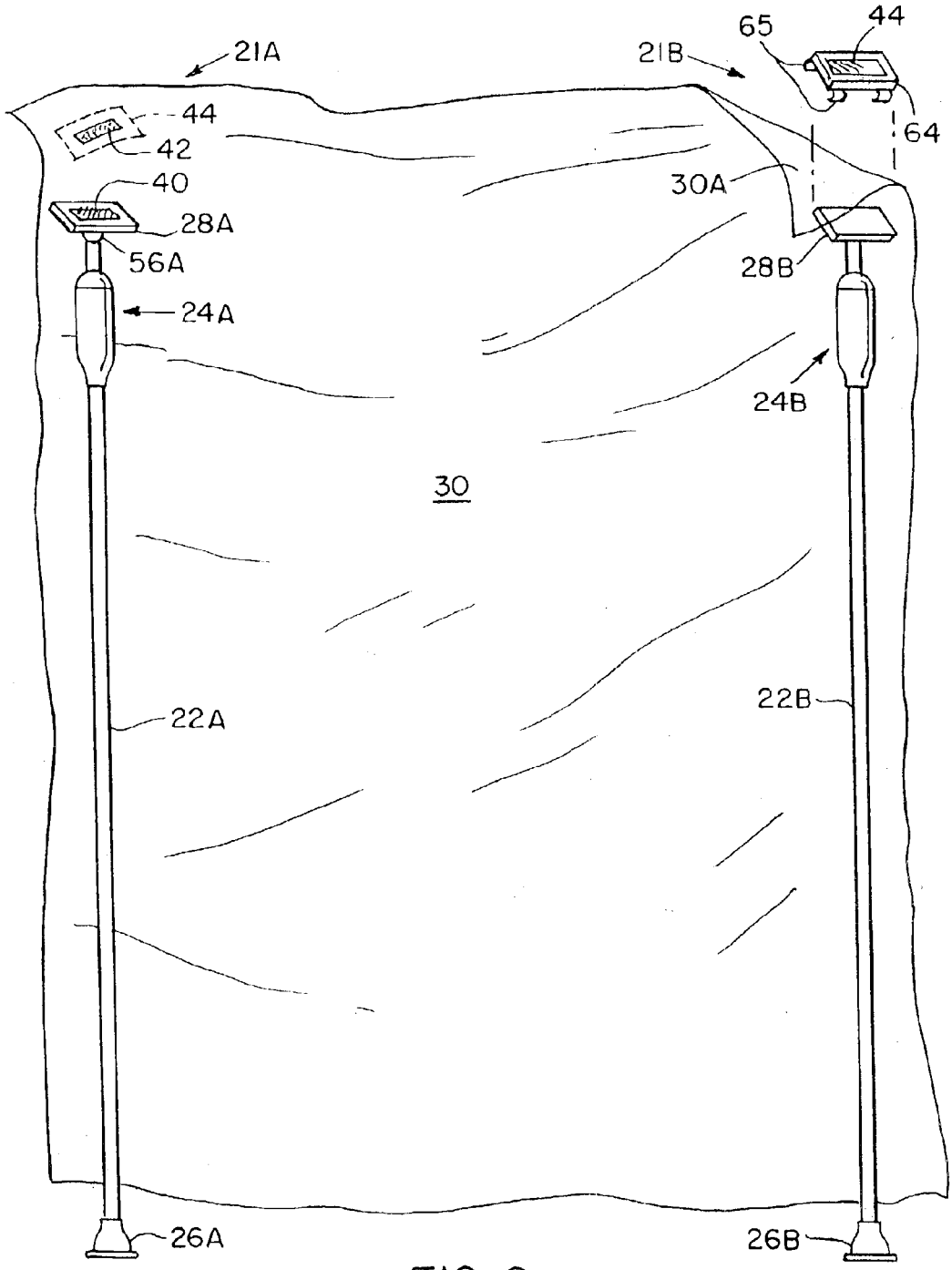
FIG. 2 illustrates the primary components of two preferred embodiments of the present invention.

FIG. 2 illustrates two preferred curtain mount embodiments. In a first Velcro™-mount embodiment 21A, an extension pole 22A having a foot 26A, for example a rubber foot 26 is coupled to a first curtain mount 24A. The curtain mount 24A is spring-loaded as described above and as will be described in further detail below.

The curtain mount includes a head 28A. The head is preferably of sufficient surface area to accommodate curtain materials of a variety of strengths and weights. For example, if the head area is too small, the head may punch through a weaker curtain material when weighted by the curtain. In a preferred embodiment of the invention, a head size of approximately 5" by 2.5" was found to be sufficient to handle most curtain materials. The head 28A includes a strip of Velcro™ loops or hooks attached thereto. The Velcro™ strip 40 on the head 28A mates with a corresponding Velcro™ strip 42 attached to a portion of the curtain 30. A strip of friction material 44 is attached to the face of the curtain 30 opposite that of the Velcro™ strip 42. In this manner, an installer can first mate the Velcro™ strips 42,40 of the curtain 30 and curtain mount 24A respectively and then raise the extension pole 22A and mount 24A such that the high friction material 44 interfaces with the ceiling. As the spring in the curtain mount 24A compresses, that compressive force operates outwardly through the head 28A, Velcro™ strips 40,42, curtain 30, and high friction material 44 against the ceiling, thereby securing the curtain 30 in place against the ceiling. A universal joint 56A at the head 28A allows for installation of a variety of angles. This allows for installation of the curtain mount of the present invention in rooms having pitched ceilings, for example cathedral ceilings.

In a second curtain mount embodiment 24B hereinafter referred to as a clip-mount, a curtain clip 64 is adapted to accept a portion 30A of a curtain 30. In a first embodiment, the clip 64 includes legs 65 adapted to snap over the body of the head 28B, thereby securing the clip 64 and curtain 30 to the head 28B. In a second embodiment, the clip 64 includes pins 112 (see FIG. 9A) which slide and lock in corresponding holes 110 in the head 28B. The top portion of the clip 64 preferably includes high friction material 44 as described above. In the clip-mount embodiment, an installer at floor level clips a portion of the curtain onto the head 28B of the curtain mount 24B and raises the curtain 30 to the ceiling using extension pole 22B. The high friction material 44 at the head 28B in combination with the rubber foot 26 provide lateral rigidity to the system, and the compressed spring in the curtain mount 24B provides longitudinal rigidity to the installed system. The clip embodiment of the curtain mount 24B offers the advantage of accepting any portion of any flexible curtain 30 material, offering an advantage over the Velcro™-mount embodiment 24A which can be coupled only to those portions of a curtain 30 having Velcro™ strips 42 previously installed thereon.

Figure 3A:
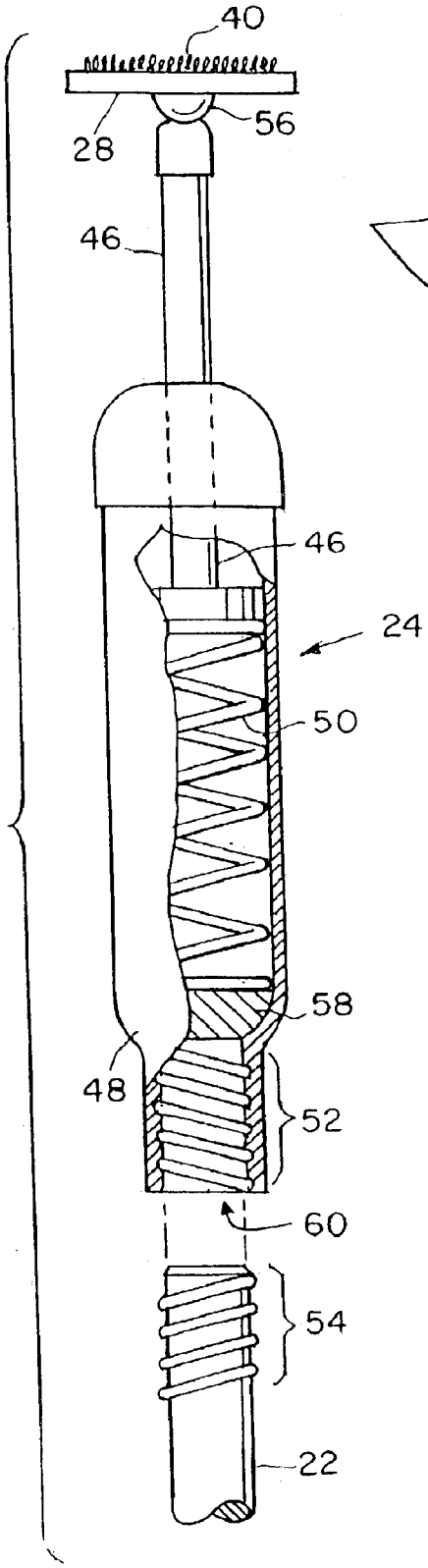
FIG. 3A is a cutaway side view of a curtain mount having a Velcro™-mount configuration in accordance with the present invention.

FIG. 3A is a cutaway side view of a Velcro™-mount embodiment of a curtain mount 24 in accordance with the present invention. The curtain mount 24 includes a body 48, a spring 50, a plunger 46, a head 28, and a hole 60 for receiving the end of an extension pole 22. The hole 60 includes internal threads 52 for mating with corresponding external threads 54 formed on the extension pole 22. The thread may comprise ¾ Acme thread, standard in the industry for painter's poles and other standard extension poles. This permits the curtain mount 24 to be compatible with commercially-available poles. When the extension pole 22 is inserted to a predetermined distance into the hole 60, a thread stopper 58 prevents the pole 22 from being inserted further.

A spring 50 rests in the body 48 of the curtain mount 24 between the rigid thread stopper 58 and the plunger 46. The spring is preferably extendable over a range of lengths, for example four inches, to accommodate extension poles of a range of lengths. The tension of the spring 50 must be high enough to support the weight of the installed curtain and low enough such that the head 28 of the curtain mount 24 does not push through the ceiling during installation. The plunger 46 and head 28 preferably interface at a universal joint 56 such that the curtain mount can be installed at a variety of angles relative to the ceiling. Velcro™ loops 40 are coupled to the outer face of the head 28. Preferred methods for coupling Velcro™ loops to the head 28 include self-adhesive Velcro™ strips and/or stapling.

Figure 3B:
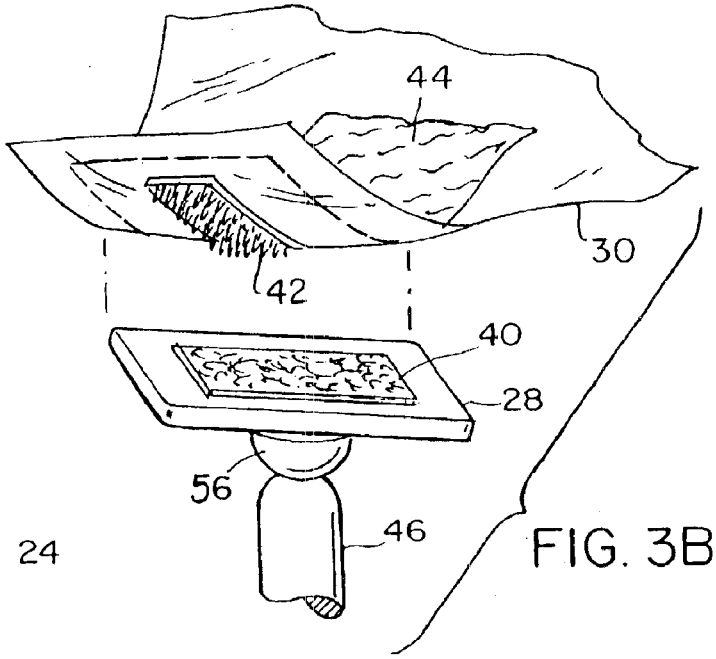
FIG. 3B is a perspective view of the head of the curtain mount of FIG. 3A interfacing with an appropriately configured curtain in accordance with the present invention.

The perspective view of FIG. 3B illustrates the head 28 and Velcro™ loops 40 coupled thereto. The Velcro™ loops 40 interface with Velcro™ hooks 42 stapled or otherwise adhered to a portion of the curtain 30. Friction material, approximately slightly larger in area than the surface area of the head 28 is disposed on the opposite face of the curtain. When the Velcro™ hooks 42 are mated to the Velcro™ loops 40, the curtain 30 is secured to the end of the curtain mount 24 and can be raised to the ceiling as shown in FIG. 3C.

Figure 3C:
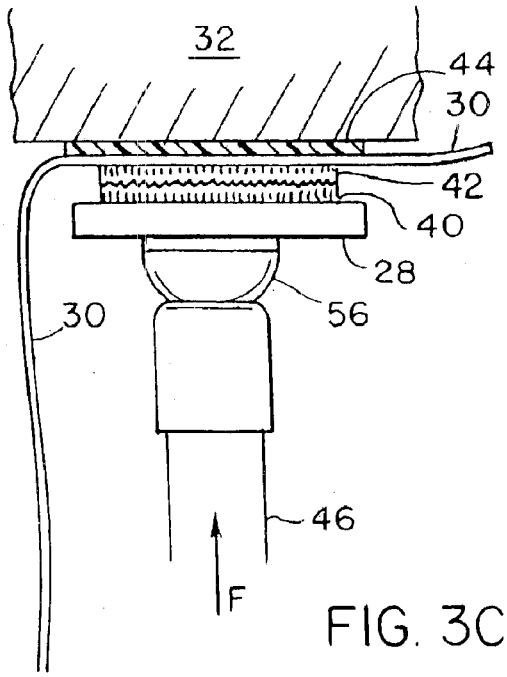
FIG. 3C is a side view of a curtain mounted to the ceiling by the curtain mount of FIG. 3A in accordance with the present invention.

In FIG. 3C, a force F generated by the compression of the spring operating on the plunger 46 urges the head 28 against the ceiling 32. The force transfers through the loops 40, the hooks 42, the curtain 30, and the high friction material 44, and operates on the ceiling 32. In this manner, the longitudinal compression of the spring acts outwardly to secure the curtain 30 against the ceiling 32.

Figure 4A:
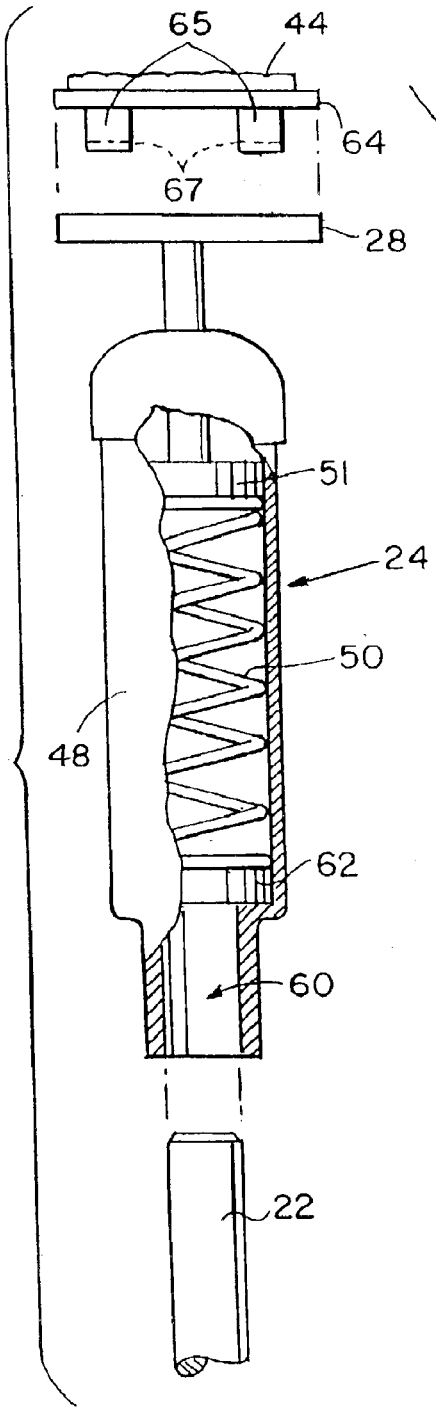
FIG. 4A is a cutaway side view of a curtain mount having a clip-mount configuration in accordance with the present invention.

FIG. 4A illustrates the clip-mount embodiment of the present invention. A curtain mount 24 includes a body 48 having a hole 60 for receiving an end of an extension pole 22, a plunger 62, a spring 50, and a fixed head 28. Note that the extension pole 22 of this embodiment is a standard thread-less pole and the hole 60 is adapted to receive the pole. In this embodiment, the pole 22 is slidable relative to the body 48 of the curtain mount 24, and communicates with the plunger 62 to compress the spring 50 against the spring stopper 51. The head 28 is longitudinally fixed, relative to the body 48. A universal joint 56 as shown in FIG. 3A may optionally be employed to couple the head 28 to the body 48 for reasons described above. A curtain clip 64 having legs 65 is adapted to snap onto the head 28, thereby clamping an inserted curtain therebetween. The clip legs 65 include tabs 67 which snap around the bottom face of the head 28 providing a secure fit. High friction material 44 is disposed on the top face of the clip 64 for interfacing with the ceiling, thereby providing lateral rigidity to the system as described above. Note that the clip design given above is merely illustrative of various clip designs which may be employed in accordance with the present invention.

Figure 4B:
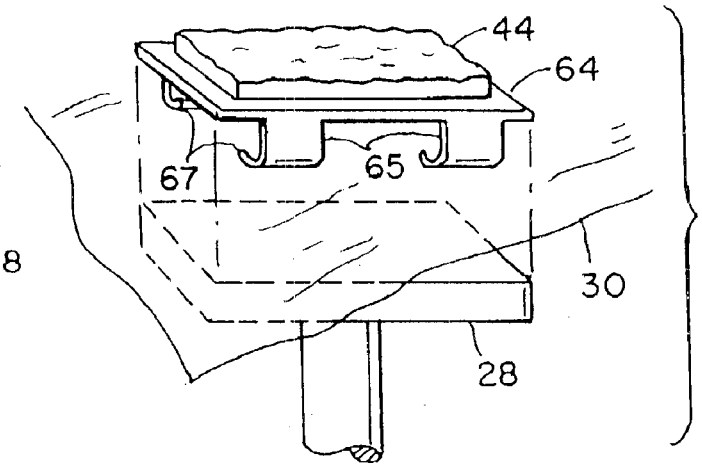
FIG. 4B is a perspective view of the interaction of the clip and head of the curtain mount of FIG. 4A in accordance with the present invention.

FIG. 4B illustrates the relative positions of the head 28, curtain 30, and clip 64 during installation. An advantage of the clip-mount embodiment over the Velcro™-mount embodiment is that the clip-mount can be secured to any portion of a curtain or sheet available to the installer. This may include a center portion of the curtain 30 or a corner portion of the curtain 30 as shown in FIG. 4B. In contrast, the Velcro™-mount embodiment requires the curtain to have portions of Velcro™ attached to the curtain at predetermined locations.

Figure 4C:
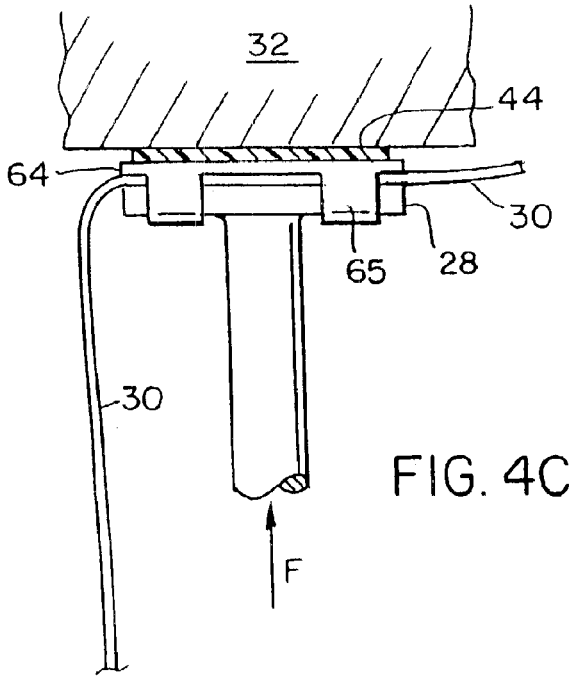
FIG. 4C is a side view of a curtain mounted to the ceiling by the curtain mount of FIG. 4A in accordance with the present invention.

FIG. 4C illustrates a curtain 30 installed against the ceiling 32 using the clip-mount. Before the curtain is raised, the clip 64 and curtain 30 are snapped and secured to the head 28. After raising the curtain against the ceiling 32, compression in the spring of the curtain mount generates a force F which operates through the head 28, curtain 30, clip 64, and high friction material 44 against the ceiling 32. The compressive force F of the spring and high friction material provide longitudinal and lateral rigidity to the system as described above.

Figure 5A:
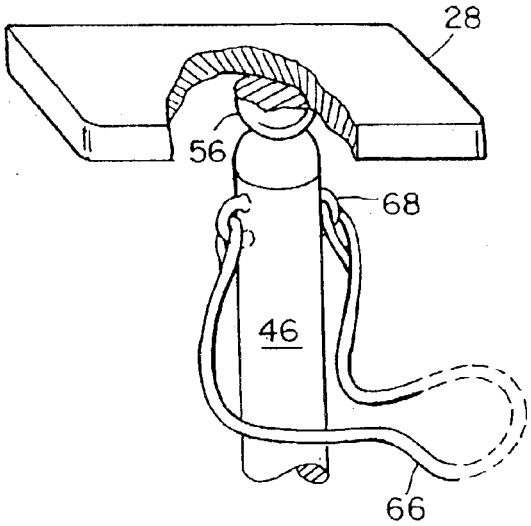
FIG. 5A is a perspective view of the head of a curtain mount including an extension loop in accordance with the present invention.

FIG. 5A is a perspective view of the head 28 of a curtain mount having an extension loop 66. The extension loop 66 is attached to the head 28, universal joint 56, plunger 46 (shown in FIG. 5A), body 48, or other portion of the curtain mount. Following installation of the curtain, the extension loop 66 allows one to reposition the head 28 relative to the ceiling without moving the extension pole. This is especially helpful for fine-tuning the adjustment of the curtain mount position, for example where the curtain exhibits sag between two installed curtain mounts, without having to move the entire pole. Operation of the extension loop is explained below with reference to FIGS. 7D–7F. The extension loop 66 may comprise string, a chain, or rod for tugging on the head.

Figure 5B:
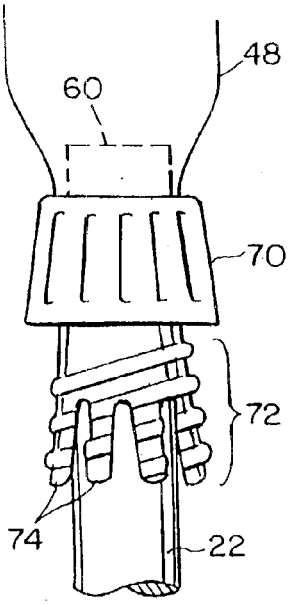
FIG. 5B is a side view of a clamped interface between the curtain mount body and an extension pole in accordance with the present invention.

FIG. 5B illustrates an alternative interface between an extension pole 22 and body 48 of a curtain mount. In this example, the body 48 of the curtain mount includes a hole 60 for receiving the end of an extension pole 22. The rim of the hole 60 includes fingers 74 which are tapered outward slightly. The fingers 74 include an external thread 72 adapted for interfacing with an internal thread on a corresponding clamp nut 70. After a pole 22 is inserted in the hole 60, the clamp 70 is slid into position and tightened around the fingers 74. The taper in the fingers 74 produces a snug fit as the clamp 70 is tightened. In this manner, the curtain mount can accommodate extension poles 22 of a variety of widths.

Figure 6:
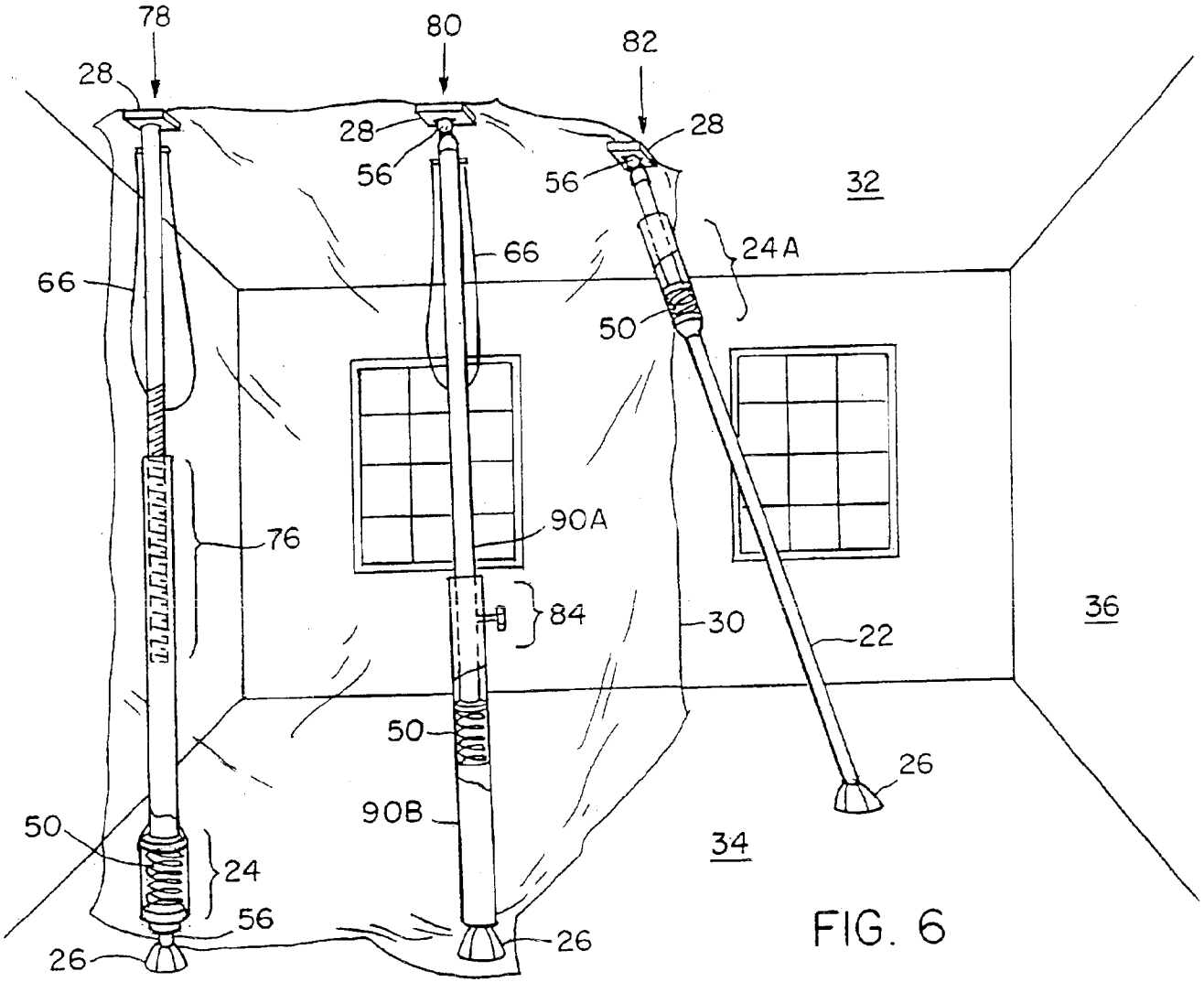
FIG. 6 illustrates a curtain installation using various preferred and alternative embodiments of the present invention.

FIG. 6 illustrates an installed curtain 30 using preferred and alternative embodiments of the present invention. The right mount 82 employs a curtain mount 24 as described above. The curtain mount 24A is coupled to a standard extension pole 22 having a foot 26 at its lower end for interfacing with the floor 34. The curtain mount includes a spring 50 in compression between the head 28 and the extension pole 22. The head 28 is coupled to the plunger of the curtain mount 24 at a swivel joint 56 accommodating installation at an angle other than perpendicular to the ceiling as shown in FIG. 6.

The center mount 80 of FIG. 6 includes the various components of a preferred embodiment of the invention described above. However, in this example the components are distributed along the length of the mount. This embodiment includes a head 28 as described above, a swivel joint 56, an extension loop 66 and an adjustable pole 90A, 90B. The pole is adjustable at a clamp 84 and is spring-loaded at spring 50. Operation of this mount is similar to those mounts described above.

Left mount 78 of FIG. 6 illustrates an alternative embodiment of the present invention. The left mount again includes the preferred components of the present invention including a head 28, extension loop 66, adjustable pole 76, curtain mount 24, spring 50, universal joint 56, and foot 26. However in this example, the curtain mount 24 is coupled to the lower end of the pole in position near the floor. The head 28 of the mount is attached directly to the opposite end of the pole and interfaces with the curtain 30 at the ceiling 32 as shown in FIG. 6 and as described above. The pole in this example employs a rotational adjustment mechanism. Also note that in the illustration of FIG. 6, a comer of the curtain 30 is held under the foot 26 of center mount 80 to provide additional tension and rigidity to the curtain.

Figure 7A:
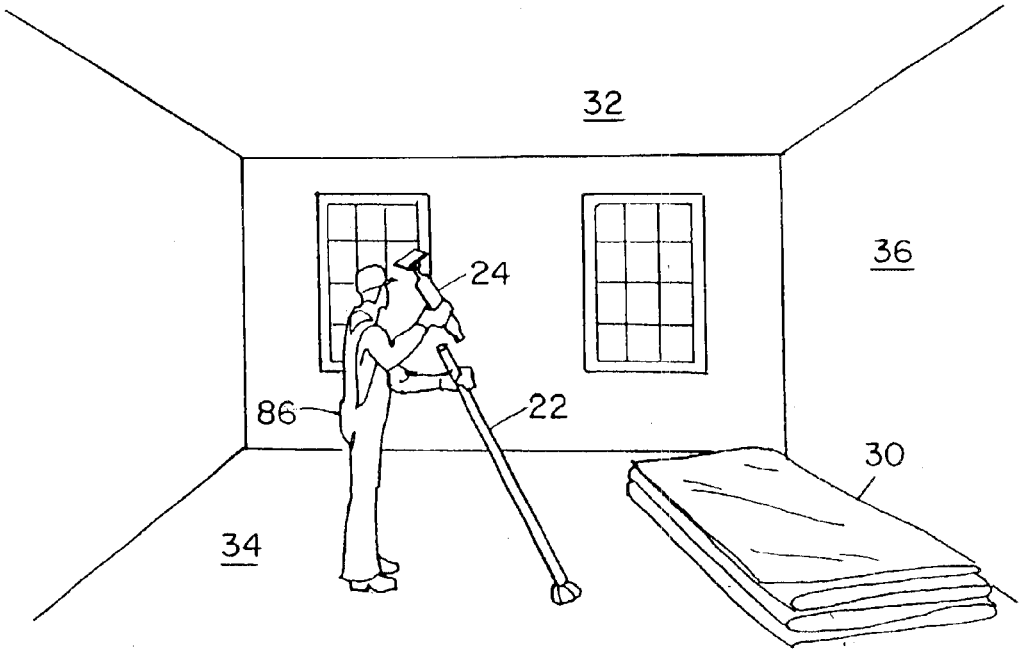
FIG. 7A–FIG. 7F illustrate an installation procedure in accordance with the present invention.

FIGS. 7A–7F illustrate a method for installing a curtain in accordance with the present invention. In FIG. 7A, an installer 86 decides which portion of the room to partition. The installer 86 selects a curtain 30 of appropriate size and attaches a curtain mount 24 to an extension pole 22 as shown. The combined length of the curtain mount 24 and pole 22 is sized to be slightly larger than the floor 34 to ceiling 32 distance, as described above.

Figure 7B:
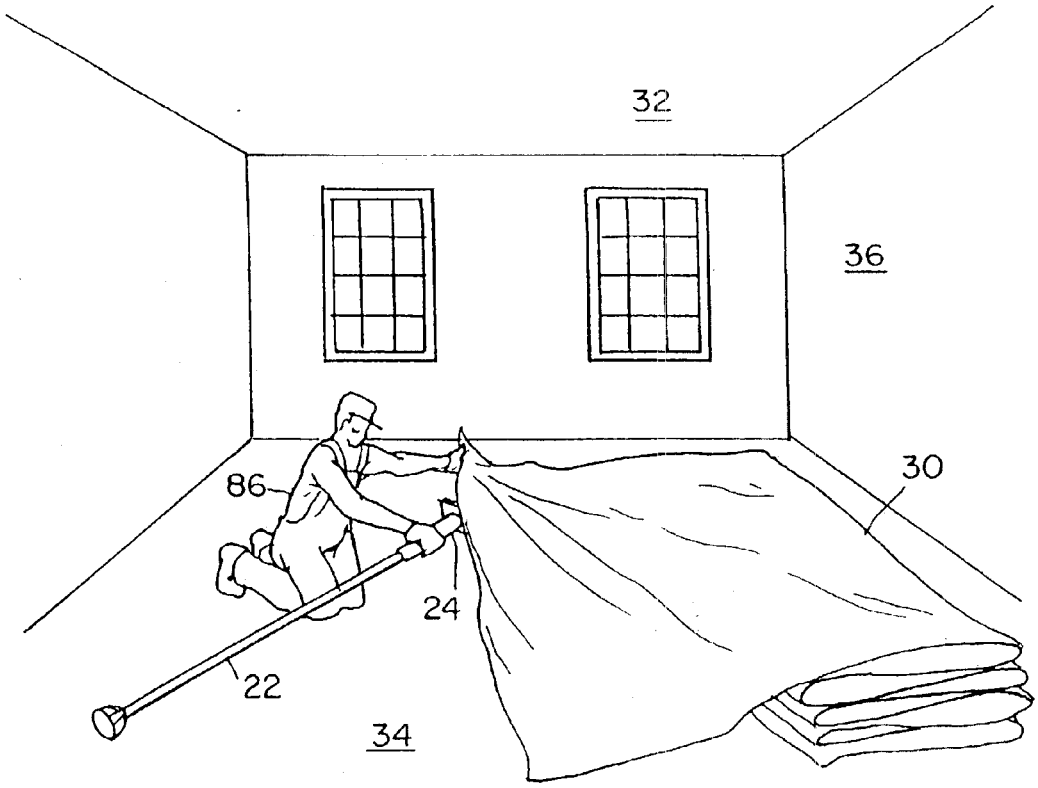

In FIG. 7B, the installer 86 mounts the curtain 30 to the head of the curtain mount 24 before raising the curtain 30. The curtain is secured to the mount by either the Velcro™-mount or clip-mount style securing mechanisms as described above.

Figure 7C:
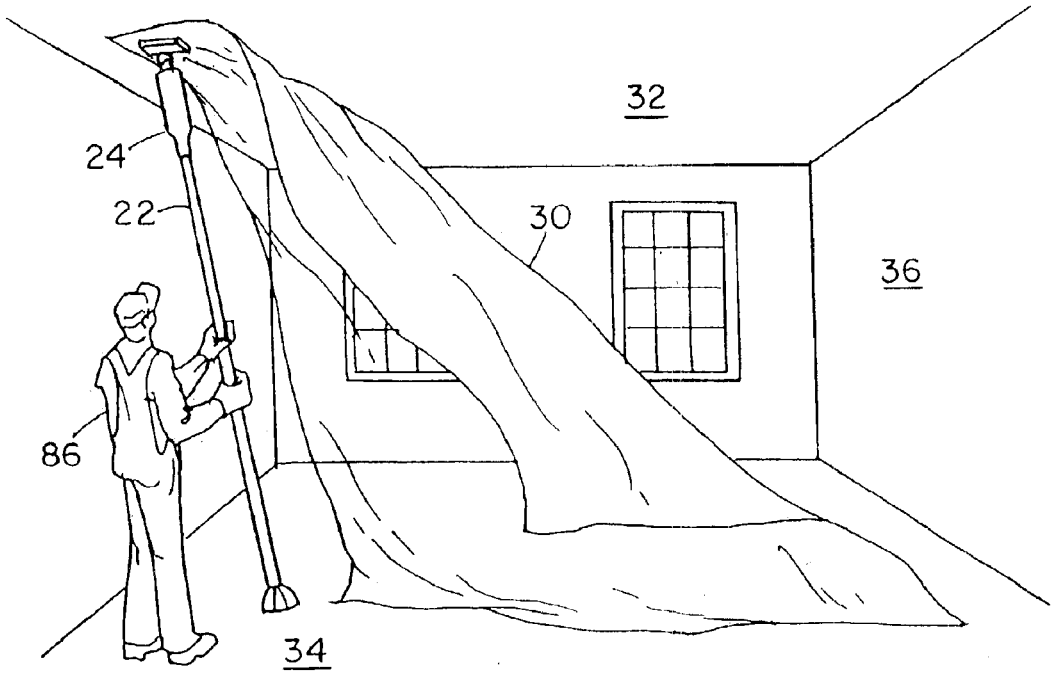

In FIG. 7C, the curtain 30 is raised to the ceiling 32 using the extension pole 22 and curtain mount 24. The pole 22 is positioned appropriately and the installer 86 pushes the pole 22 against the ceiling 32 to compress the spring in the curtain mount 24.

Figure 7D:
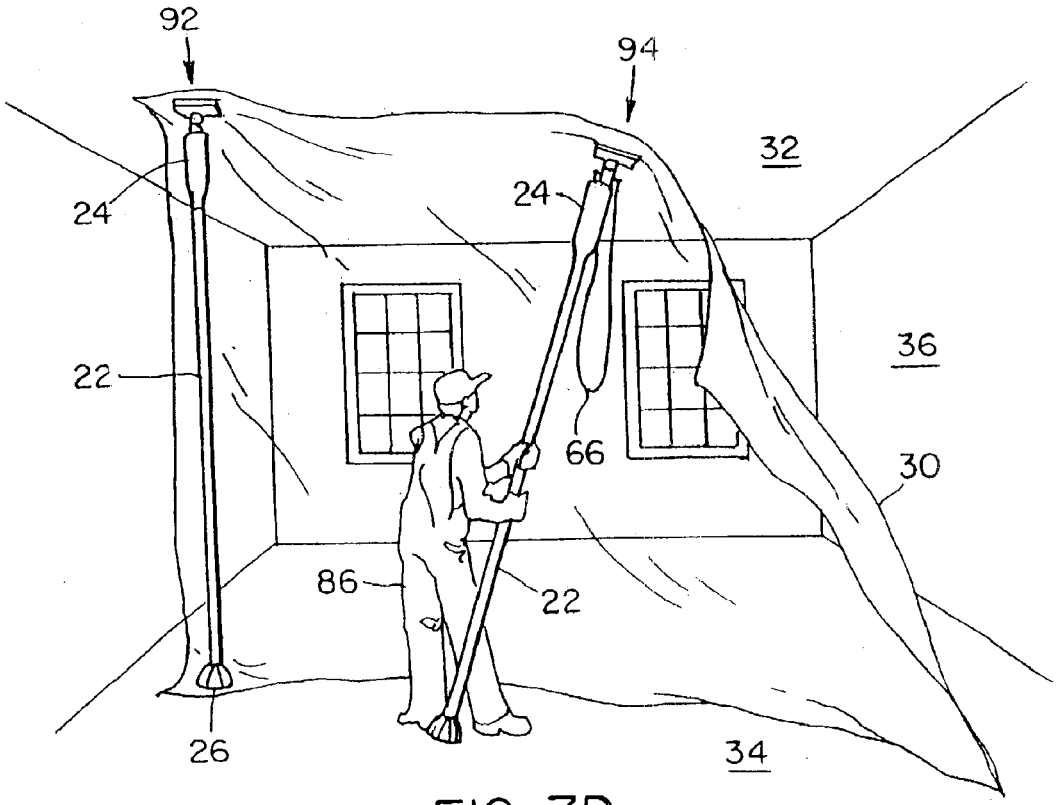

In FIG. 7D, the first mount 92 is shown in position with the head of the curtain mount urging the curtain 30 against the ceiling 32. In this installation, the installer 86 also decided to tuck a lower portion of the curtain 30 under the foot 26 to add tension to the curtain and secure the curtain to the floor. Following this, in FIG. 7D, the installer 86 has coupled a second portion of the curtain 30 to a second mount 94 and is in the process of raising the second mount 94 into position a few feet from the first mount 92.

Figure 7E:
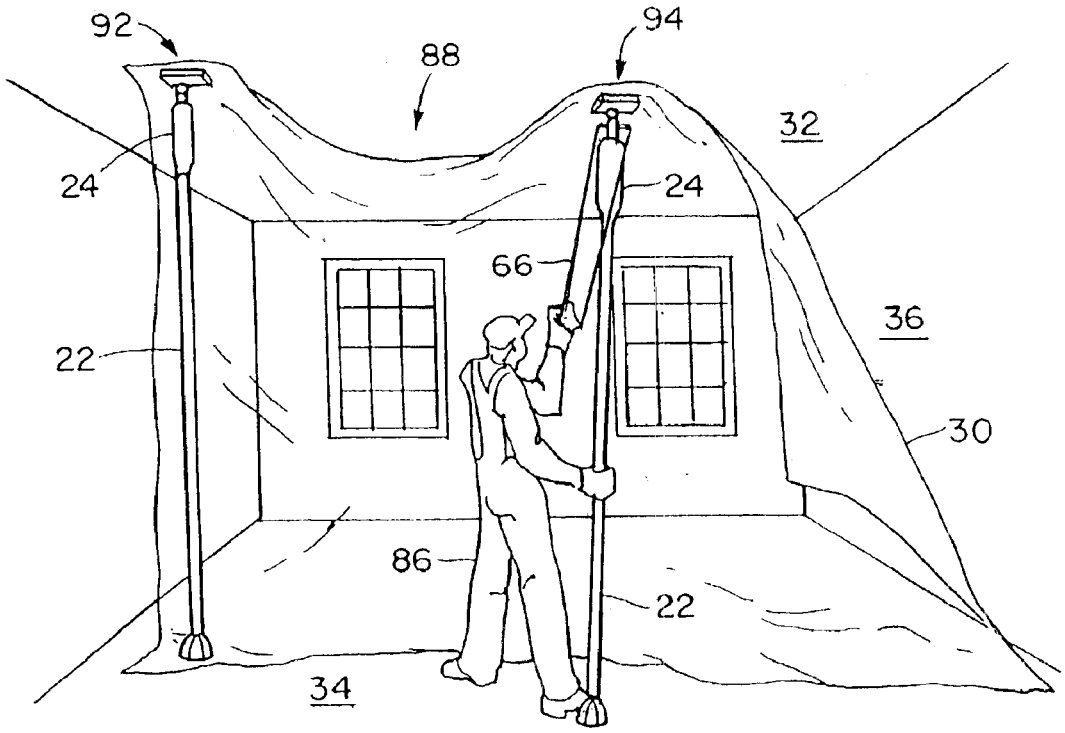

After positioning the second mount 94 as shown in FIG. 7E, the installer 86 noticed that a sag 88 is present in the curtain 30 between the first 92 and second 94 mounts which is undesirable for the installer's project. An extension loop 66 is coupled to the head of the curtain mount 24, thereby allowing the installer 86 to fine-tune the position of the second mount 94 relative to the first mount 92 to eliminate the sag 88 in the curtain 30.

Figure 7F:
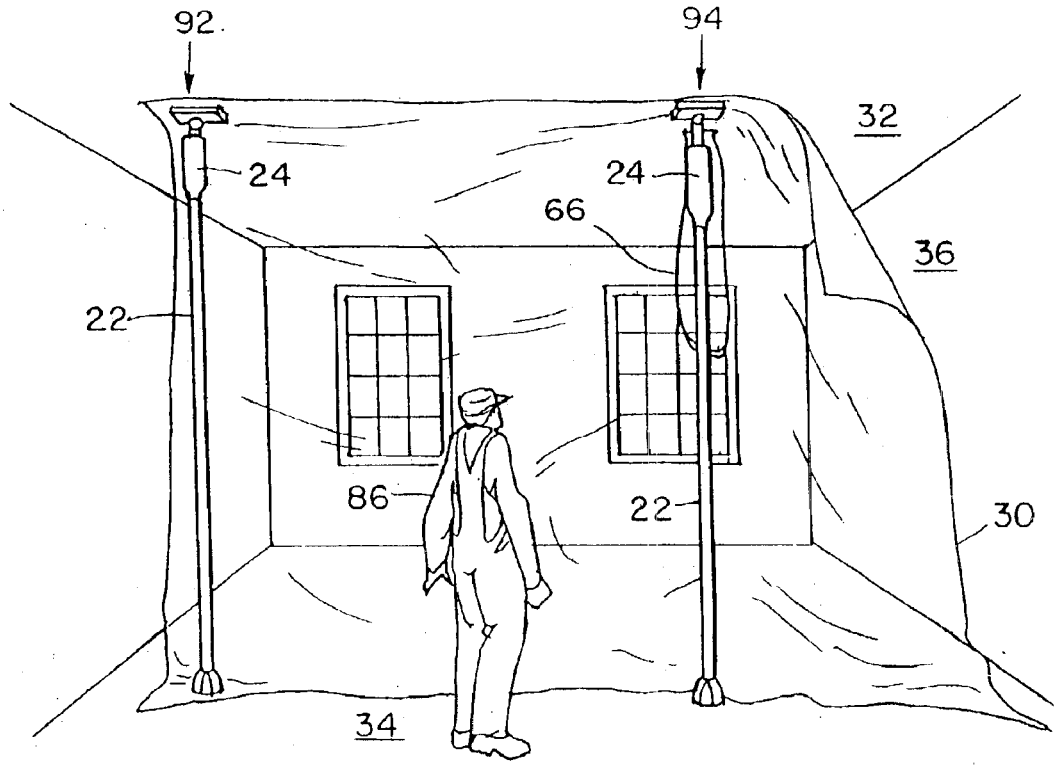

The resulting installation is shown in FIG. 7F. It can be seen that the sag 88 exhibited in FIG. 7E has been eliminated in FIG. 7F by increasing the distance between the first mount 92 and the second mount 94, thereby tensioning the curtain 30 between the two mounts. Additional mounts may be added as described above resulting in partition configurations as shown in FIGS. 1A–1C.

Figure 8C:
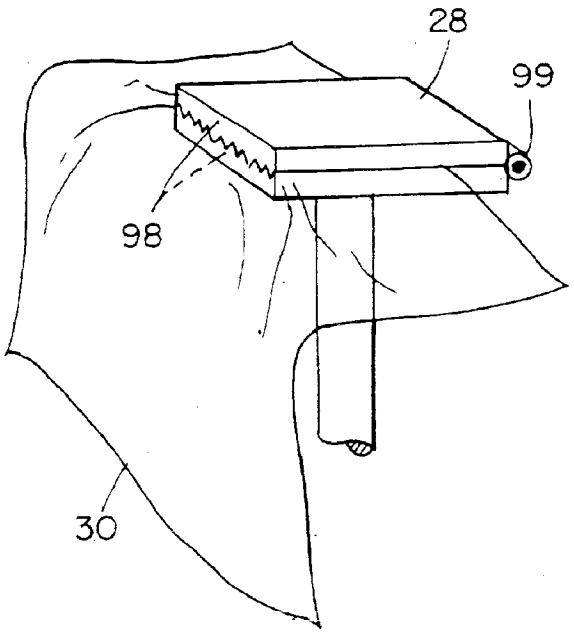
FIG. 8A–FIG. 8C are perspective views of alternative embodiments for coupling the curtain to the head.
Figure 8B:
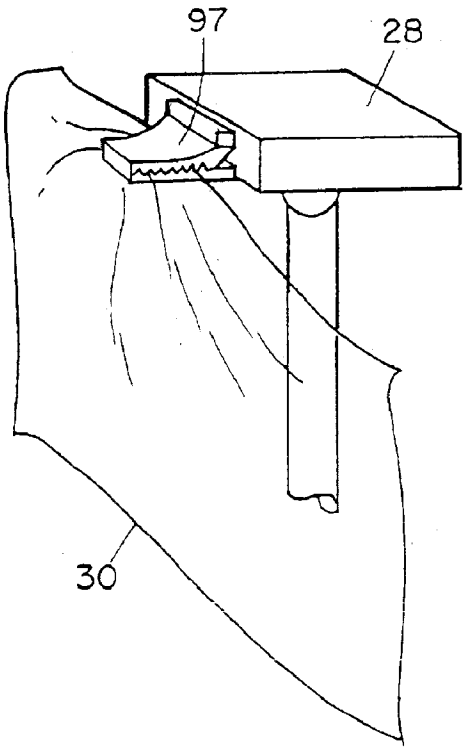
Figure 8A:
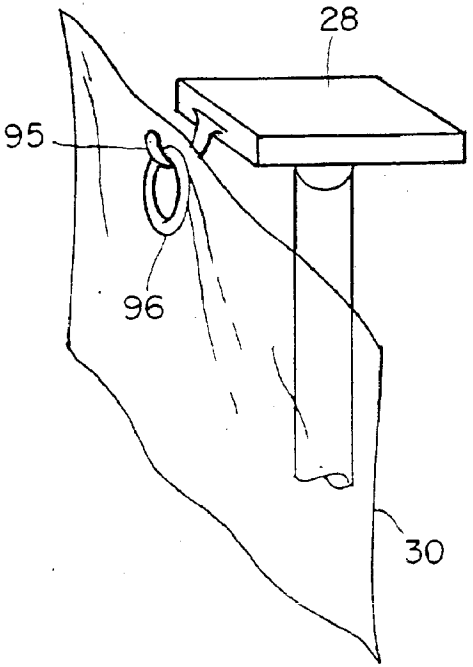

FIGS. 8A–8C illustrate alternative coupler embodiments for coupling the curtain 30 to the head 28. In FIG. 8A, a hook 95 is installed on a side of the head 28. The hook 95 interfaces with a grommet 96 or other opening in the curtain 30 for supporting the curtain during and following installation. In FIG. 8B, a spring-biased clamp 97 secures the curtain 30 in its jaws. In FIG. 8C, the head 28 is formed in two sections which interface at a hinge 99. The sections join at jaws 98 to clamp the curtain 30, thereby securing it to the head 28. In the embodiments shown in FIGS. 8A–8C, the curtain 30, when installed, is not urged against the ceiling by the top face of the head 28. Instead, the curtain hangs from the side of the head 28.

A distinct advantage of the present invention over the prior art is its ability to interface with and utilize curtains, poles, and extension rods which are available off the shelf. Preferred curtain materials depend on the application and include cloth or canvas sheets, plastic sheets, and reinforced plastic tarps. Standard poles include extension poles, painter's poles, telescoping poles, and window washing poles. High friction materials include silicone, rubber, and non-skid material for carpeting. Compression mechanisms include springs, pneumatic devices and hydraulic devices.

More curtain mounts may be used for installations requiring heavier curtain materials or for installations which require the partition to be substantially air-tight, for example, asbestos removal and lead paint removal applications.

The present invention is also applicable for creating temporary private areas using standard sheets and blankets for curtains. This would be particularly useful in emergency shelters or in crowded hospitals.

While this invention has been particularly shown and described with references to preferred embodiments thereof, it will be understood by those skilled in the art that various changes in form and detail may be made therein without departing from the spirit and scope of the invention as defined by the appended claims.

Figure 9A:
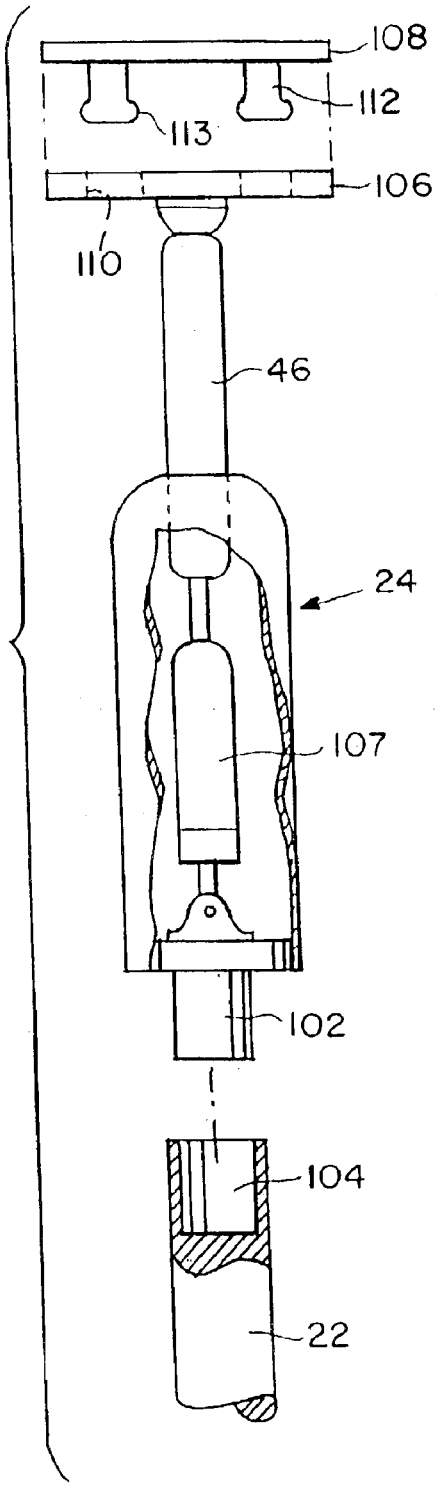
FIG. 9A–FIG. 9C are perspective views of an alternative embodiment of a curtain mount in accordance with the present invention illustrating an alternative curtain coupler, an alternative pole interface, and an alternative compression mechanism.
Figure 9B:
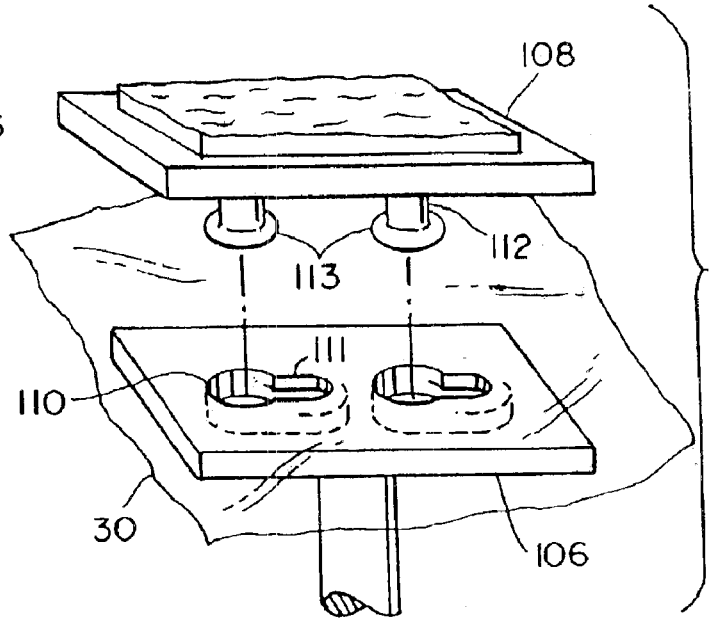
Figure 9C:
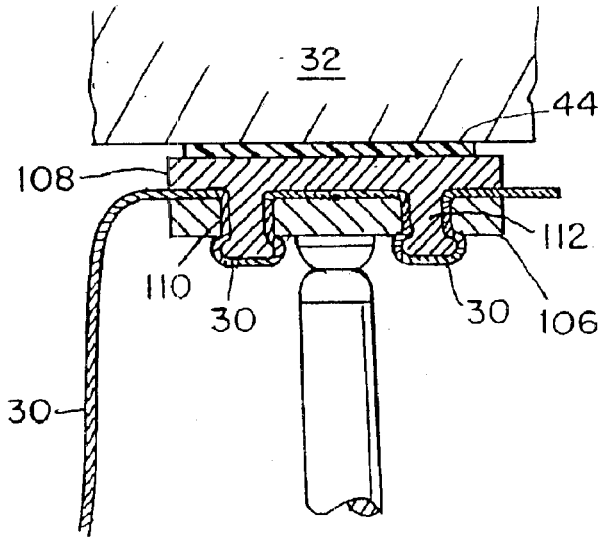

An example of an alternative embodiment of the curtain mount is illustrated in FIGS. 9A, 9B and 9C. This curtain mount embodiment includes a hydraulic or pneumatic device 107 serving as a compression mechanism. A proximal end of the mount includes a pole interface comprising a pin 102 which mates with a corresponding hole 104 on the extension pole 22. The head 106 is mounted to the plunger 46 as shown.

The head 106 includes at least one hole 110 adapted to interface with and receive at least one corresponding pin 112 located on a clip plate 108. The pins 112 and a portion of a curtain 30 together insert into the holes 110, and slide and lock in place in the keyhole slots 111 shown in FIG. 9B. A knob 113 at the end of each pin 112 prevents a mounted plate 108 from releasing from the head 106.

FIG. 9C illustrates the resulting installed configuration of the curtain mount of FIGS. 9A and 9B. A portion of the curtain 30 wraps around the pins 112 and is secured in holes 110. The outward force of the hydraulic plunger urges the curtain 30 toward the ceiling 32 as described above.

I claim:

1. A mounting system for installing a curtain comprising:

a pole having first and second ends;

a foot at a first end of the pole;

a head at a second end of the pole;

a compression mechanism between the foot and head; and a clamp including an engagement arm that engages an exterior side surface of the head to secure a curtain to the side surface of the head at an engagement location that is lower than a top portion of the head, the clamp being pivotably coupled to the head such that the engagement arm pivots between a secure position and an open position.

2. The mounting system of claim 1 wherein the engagement arm is adapted to secure a curtain against a side portion of the head.

3. The mounting system of claim 1 wherein the engagement arm is further adapted to secure a curtain against the top portion of the head.

4. The mounting system of claim 1 wherein the engagement arm operates under force to urge the curtain against the head.

5. The mounting system of claim 1 wherein the clamp is removably coupled to the head.

6. The mounting system of claim 1 further comprising an interface between the pole and the head.

7. The mounting system of claim 1 further comprising a universal joint between the pole and the head.

8. The mounting system of claim 1 wherein the head comprises a high-friction material.

9. The mounting system of claim 8 wherein the high-fiction material comprises rubber.

10. The mounting system of claim 1 wherein the pole comprises an adjustable-length pole.

11. The mounting system of claim 1 wherein the clamp is biased by a spring to urge the engagement arm against the head.

12. The mounting system of claim 11 wherein the engagement arm includes an engagement surface that is biased against the head by the spring.

13. The mounting system of claim 12 wherein the engagement arm includes a handle to which an applied force operates against the bias of the spring to separate the engagement surface from the head.

14. The mounting system of claim 1 wherein the engagement arm is urged against the head in the secure position and wherein the engagement arm is separated from the head in the open position.

15. The mounting system of claim 1 wherein when the engagement arm is in the secure position, the engagement arm secures the curtain to the head with a force that is adapted to prevent slippage of a curtain mounted thereto with respect to the head, and such that when the engagement arm is in the open position, the separation between the engagement arm and head is of a sufficient distance such that a curtain can be positioned between the engagement arm and the head.

16. The mounting system of claim 1 wherein the compression mechanism is configured to urge the head away from the foot.

17. A mount attachable to an extension pole for installing a curtain comprising:

an interface at a proximal end of the mount adapted for coupling the mount to an extension pole;

a compression mechanism along a longitudinal axis of the mount;

a head at a distal end of the mount, the compression mechanism operable to urge the head away from the interface; and a clamp including an engagement arm that engages an exterior side surface of the head to secure a curtain to the side surface of the head at an engagement location that is lower than a top portion of the head, the clamp being pivotably coupled to the mount such that the engagement arm pivots between a secure position and an open position.

18. The mount of claim 17 wherein the engagement arm is adapted to secure a curtain against a side portion of the head.

19. The mount of claim 17 wherein the engagement arm is further adapted to secure a curtain against the top portion of the head.

20. The mount of claim 17 wherein the engagement arm operates under force to urge the curtain against the head.

21. The mount of claim 17 wherein the clamp is removably coupled to the head.

22. The mount of claim 17 wherein the clamp is pivotably coupled to the mount proximal to the head.

23. The mount of claim 17 wherein the interface comprises a hole having an internal thread.

24. The mount of claim 17 wherein the interface comprises a hole adapted to mate with a pin on the extension pole in a slip-fit relationship.

25. The mount of claim 17 wherein the interface comprises a pin adapted to mate with a hole on the extension pole in a slip-fit relationship.

26. The mount of claim 17 further comprising a universal joint between the interface and the head.

27. The mount of claim 17 wherein the head comprises a high-friction material.

28. The mount of claim 27 wherein the high-friction material comprises rubber.

29. The mount of claim 17 adapted to be secured to an adjustable-length extension pole at the interface.

30. The mount of claim 17 wherein the clamp is biased by a spring to urge the engagement arm against the head.

31. The mount of claim 30 wherein the engagement arm includes an engagement surface that is biased against the head by the spring.

32. The mount of claim 31 wherein the engagement arm includes a handle to which an applied force operates against the bias of the spring to separate the engagement surface from the head.

33. The mount of claim 17 wherein the engagement arm is urged against the head in the secure position, and wherein the engagement arm is separated from the head in the open position.

34. The mount of claim 17 wherein when the engagement arm is in the secure position, the engagement arm secures the curtain to the head with a force that is adapted to prevent slippage of a curtain mounted thereto with respect to the head, and such that when the engagement arm is in the open position, the separation between the engagement arm and head is of a sufficient distance such that a curtain can be positioned between the engagement arm and the head.

35. A mounting system for installing a sheet of material comprising:

a pole having first and second ends;

foot at a first end of the pole;

a head at a second end of the pole, the head having an upper first engaging surface;

an adjustment mechanism between the foot and head for adjusting the length of the pole therebetween; and a clip having a lower second engaging surface that removably engages the upper first engaging surface of the head for mounting a sheet of material therebetween, and a plurality of legs extending transverse to the second engaging surface of the clip to removably secure the clip to the head, the plurality of legs extending about at least one side surface and a portion of a lower surface of the head when the clip is engaged with the head.

36. The mounting system of clam 35 wherein the legs include tabs which extend about the portion of the lower surface of the head.

37. The mounting system of claim 35 wherein the head extends transverse to a longitudinal axis of the pole.

38. The mounting system of claim 35 wherein the first and second engaging surfaces are substantially planar.

39. The mounting system of claim 35 further comprising a compression mechanism between the foot and the head.

40. The mounting system of claim 39 wherein the compression mechanism comprises a spring.

41. The mounting system of claim 35 wherein the legs are elastically deformable and snap about at least one side surface of the head.

42. The mounting system of claim 35 wherein the legs are configured such that the clip is slidable relative to the head.

43. The mounting system of claim 35 wherein the clip and head are rectangular in shape.

44. The mounting system of claim 35 further comprising high-friction material applied to an upper surface of the clip.

45. A mounting system for installing a curtain comprising:

a pole having first and second ends;

a foot at a first end of the pole;

a head at a second end of the pole;

a compression mechanism between the foot and head; and a clamp including an engagement arm that engages an exterior side surface of the head to secure a curtain to the side surface of the head at an engagement location that is lower than a top portion of the head, the clamp being pivotably coupled to the mounting system such that the engagement arm pivots between a secure position and an open position.

46. The mounting system of claim 45 wherein the clamp is pivotably coupled to the mounting system proximal to the head.

47. The mounting system of claim 45 wherein the engagement arm is adapted to secure a curtain against a side portion of the head.

48. The mounting system of claim 45 wherein the engagement arm is further adapted to secure a curtain against the top portion of the head.

49. The mounting system of claim 45 wherein the engagement arm operates under force to urge the curtain against the head.

50. The mounting system of claim 45 wherein the clamp is removably coupled to the pole.

51. The mounting system of claim 45 further comprising an interface between the pole and the head.

52. The mounting system of claim 45 further comprising a universal joint between the pole and the head.

53. The mounting system of claim 45 wherein the head comprises a high-friction material.

54. The mounting system of claim 53 wherein the high-friction material comprises rubber.

55. The mounting system of claim 45 wherein the pole comprises an adjustable-length pole.

56. The mounting system of claim 45 wherein the clamp is biased by a spring to urge the engagement arm against the head.

57. The mounting system of claim 56 wherein the engagement arm includes an engagement surface that is biased against the head by the spring.

58. The mounting system of claim 57 wherein the engagement arm includes a handle to which an applied force operates against the bias of the spring to separate the engagement surface from the head.

59. The mounting system of claim 45 wherein the engagement arm is urged against the head in the secure position and wherein the engagement arm is separated from the head in the open position.

60. The mounting system of claim 45 wherein when the engagement arm is in the secure position, the engagement arm secures the curtain to the head with a force that is adapted to prevent slippage of a curtain mounted thereto with respect to the head, and such that when the engagement arm is in the open position, the separation between the engagement arm and head is of a sufficient distance such that a curtain can be positioned between the engagement arm and the head.

61. The mounting system of claim 45 wherein the compression mechanism is configured to urge the head away from the foot.

* * * * *

UNITED STATES PATENT AND TRADEMARK OFFICE

CERTIFICATE OF CORRECTION

PATENT NO. : 6,942,004 B2
APPLICATION NO. : 10/301233
DATED : September 13, 2005
INVENTOR(S) : Jeffrey P. Whittemore It is certified that error appears in the above-identified patent and that said Letters Patent is hereby corrected as shown below:

In Claim 36, column 11, line 35, delete “clam” and insert --claim--.

Signed and Sealed this

Eighth Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 6,942,004 B2
APPLICATION NO. : 10/301233
DATED : September 13, 2005
INVENTOR(S) : Jeffrey P. Whittemore It is certified that error appears in the above-identified patent and that said Letters Patent is hereby corrected as shown below:

In paragraph 1, column 1, line 11, delete "5,924,629" and insert --5,924,469--.

Signed and Sealed this

Twenty-first Day of November, 2006

JON W. DUDAS
*Director of the United States Patent and Trademark Office*